US007418906B2

(12) United States Patent
Brislin et al.

(10) Patent No.: US 7,418,906 B2
(45) Date of Patent: Sep. 2, 2008

(54) DUAL SPIN CANISTER AMMUNITION

(75) Inventors: Philip Brislin, Budd Lake, NJ (US); Stephen Ginetto, Carlstadt, NJ (US); Jeffery McNaboe, Sparta, NJ (US); Roger Joinson, Boonton, NJ (US); Richard DalBraccio, Dover, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 454 days.

(21) Appl. No.: 11/161,667

(22) Filed: Aug. 11, 2005

(65) Prior Publication Data

US 2007/0006767 A1 Jan. 11, 2007

Related U.S. Application Data

(60) Provisional application No. 60/522,201, filed on Aug. 31, 2004.

(51) Int. Cl.
*F42B 12/64* (2006.01)

(52) U.S. Cl. ..... 102/494; 102/493; 102/489; 102/703; 102/457; 102/506

(58) Field of Classification Search ..... 102/449, 102/457, 464, 489, 506, 703, 493, 494, 491, 102/454
See application file for complete search history.

(56) References Cited

U.S. PATENT DOCUMENTS

| | | | | | |
|---|---|---|---|---|---|
| 1,388,503 | A * | 8/1921 | Ayer | ..... | 102/454 |
| 3,598,057 | A * | 8/1971 | Potter | ..... | 102/452 |
| 3,670,651 | A * | 6/1972 | Mertens | ..... | 102/452 |
| 3,981,242 | A * | 9/1976 | Shurtleff | ..... | 102/454 |
| 3,991,682 | A * | 11/1976 | Peak | ..... | 102/438 |
| 5,796,031 | A * | 8/1998 | Sigler | ..... | 102/520 |
| 6,701,848 | B1 * | 3/2004 | Georgantzis et al. | ..... | 102/506 |
| 6,988,450 | B1 * | 1/2006 | Georgantzis et al. | ..... | 102/401 |

* cited by examiner

*Primary Examiner*—James S Bergin
(74) *Attorney, Agent, or Firm*—John F. Moran

(57) ABSTRACT

A dual spin projectile includes a base; a body connected to the base with a first snap joint, the first snap joint allowing relative rotation between the base and the body; a can having an open forward end and connected to the body with a second snap joint, the second snap joint allowing relative rotation between the body and the can; an aft payload disposed in the body; a forward payload disposed in the can; and a cap connected to the can and closing the open forward end of the can.

4 Claims, 6 Drawing Sheets

DUAL SPIN CANISTER AMMUNITION

CROSS-REFERENCE TO RELATED APPLICATIONS

This application claims the benefit under 35 USC 119(e) of U.S. provisional patent application 60/522201 filed on Aug. 31, 2004, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to gun launched ammunition and in particular to gun launched canister ammunition.

Antipersonnel/canister cartridges have been produced for 105 mm caliber and other gun calibers since cannons came into use. The basic principle of antipersonnel/canister cartridges is the expulsion of a large number of lethal fragments, flechettes or other geometric shape objects. The various objects are accelerated during gun launch or during a detonation of an explosive charge to achieve a lethal velocity or the kinetic energy needed to accomplish suppression of troops, targets, or material obstacles. Typically a distinction is made between antipersonnel cartridges which implement an explosive fuze for dispersion, and canister cartridges that spread via mechanical, aerodynamic, or inertial forces.

Several types of canister (no fuze) projectiles have been developed. These canister projectiles employ a cup type design to carry the lethal mechanisms during the cannon launch. This concept has been employed for a number of years in shotgun ammunition, 90 mm ammunition and more recently in 120 mm smooth bore ammunition. Upon exit of the gun, the lethal mechanisms are dispersed by the resultant gun forces and acted upon by aerodynamic forces so as to disperse the sub-projectiles in a pattern. The sub-projectiles then travel ballistically until impact with the target of interest.

An important aspect of canister cartridge performance is to deploy the lethal mechanisms in a desired pattern, while assuring a density of sub projectiles that produce the desired end effect. U.S. Pat. No. 6,701,848 discloses a 105 mm canister cartridge that disperses a payload of sub-projectiles via gun launch and aerodynamic forces. However, the single dispersion cone angle that is produced does not provide sufficient density across all required ranges to fulfill the current lethality need. The present invention is a dual spin projectile that improves sub-projectile density across required ranges.

SUMMARY OF THE INVENTION

A first embodiment of the invention is a projectile comprising a base; a body connected to the base with a first snap joint, the first snap joint allowing relative rotation between the base and the body; a can having an open forward end and connected to the body with a second snap joint, the second snap joint allowing relative rotation between the body and the can; an aft payload disposed in the body; a forward payload disposed in the can; and a cap connected to the can and closing the open forward end of the can.

A second embodiment of the invention is a projectile comprising a base; a body connected to the base such that the base and the body rotate together; a can having an open forward end and connected to the body with a snap joint, the snap joint allowing relative rotation between the body and the can; an aft payload disposed in the body; a forward payload disposed in the can; and a cap connected to the can and closing the open forward end of the can.

A third embodiment of the invention is a projectile comprising a base; a body connected to the base such that the base and the body rotate together; a bulkhead connected to the body such that the bulkhead and the body rotate together; a can having an open forward end and connected to the bulkhead with at least one shear bolt; an aft payload disposed in the body; a forward payload disposed in the can; and a cap connected to the can and closing the open forward end of the can.

A fourth embodiment of the invention is a projectile comprising a base; a can connected to the base with a snap joint, the snap joint allowing relative rotation between the base and the can, the can having a forward open end; a payload disposed in the can; and a cap connected to the can and closing the open forward end of the can.

A fifth embodiment of the invention is a projectile comprising a base; a body connected to the base with a first lap joint, the first lap joint allowing relative rotation between the base and the body; a can having an open forward end and connected to the body with a second lap joint, the second lap joint allowing relative rotation between the body and the can; a bolt fixed in a central opening in the base, extending through a central opening in the can and ending with a nut to thereby hold the base to the can while allowing the bolt and base to rotate relative to the can; an aft payload disposed in the body; a forward payload disposed in the can; and a cap connected to the can and closing the open forward end of the can.

The invention will be better understood, and further objects, features, and advantages thereof will become more apparent from the following detailed description of the preferred embodiments, taken in conjunction with the accompanying drawings.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION OF THE PREFERRED EMBODIMENTS

Figure 1:
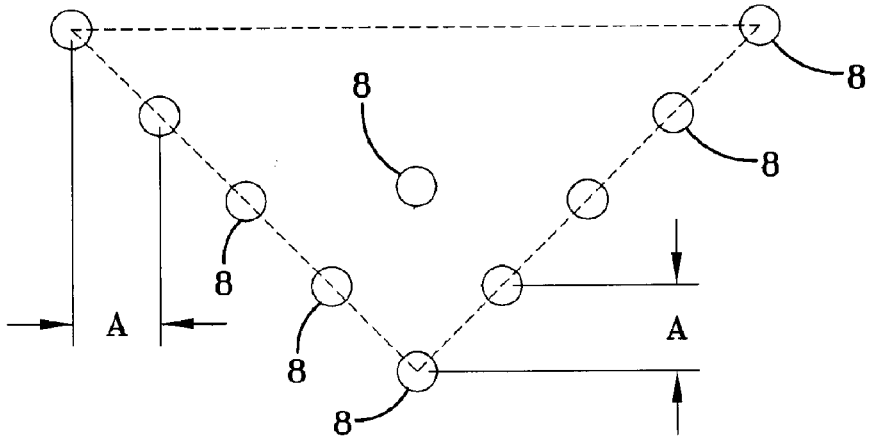
FIG. 1 schematically shows a 10 man dismounted infantry squad arranged in a "V" formation.

The present invention arose in response to an Army need for a canister projectile that can defeat a 10 man dismounted infantry squad arranged in a "V" formation between the ranges of 100 meters and 300 meters. The 10-man squad is illustrated in FIG. 1. In FIG. 1, each man 8 is represented by a circle. The distance A between each man 8 along the "V" is about five meters. In response to the Army need, the invention was designed to provide the user with an anti-personnel and/or anti-material capability for a range of 2 meters through 500 meters in rifled 105 mm M68 cannons. The invention can also be used with a host of other rifled cannons of various calibers.

Figure 2:
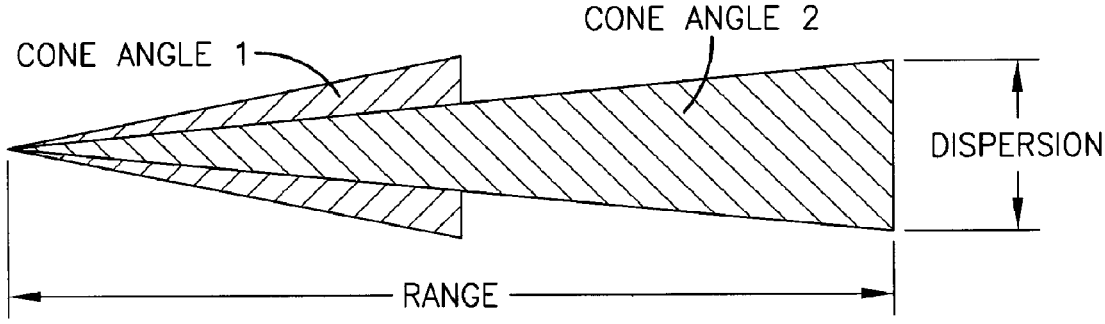
FIG. 2 shows two cone angles of dispersion.
Figure 3:
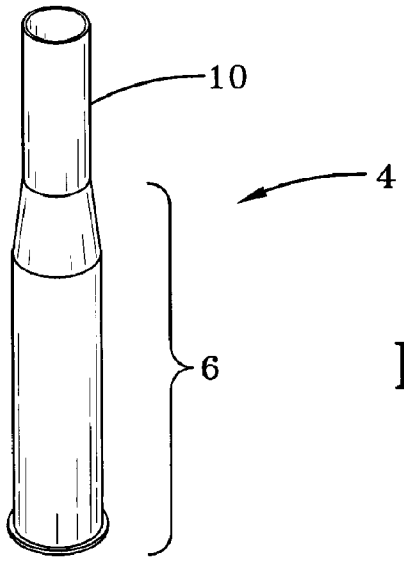
FIG. 3 is a perspective view of a gun fired ammunition round.

The new 105 mm canister projectile utilizes dual spin rates to disperse the lethal payload into two cone angles as shown in FIG. 2. The dual spin feature provides a sufficiently lethal payload density and dispersion across a much larger range than a single spin design with one cone angle. The dual spin feature, wherein the forward body decouples from the aft body, is transferable to other calibers and projectile designs. FIG. 3 is a perspective view of a gun fired ammunition round 4. Round 4 includes a canister projectile 10 and a propellant filled cartridge 6.

Figure 4:
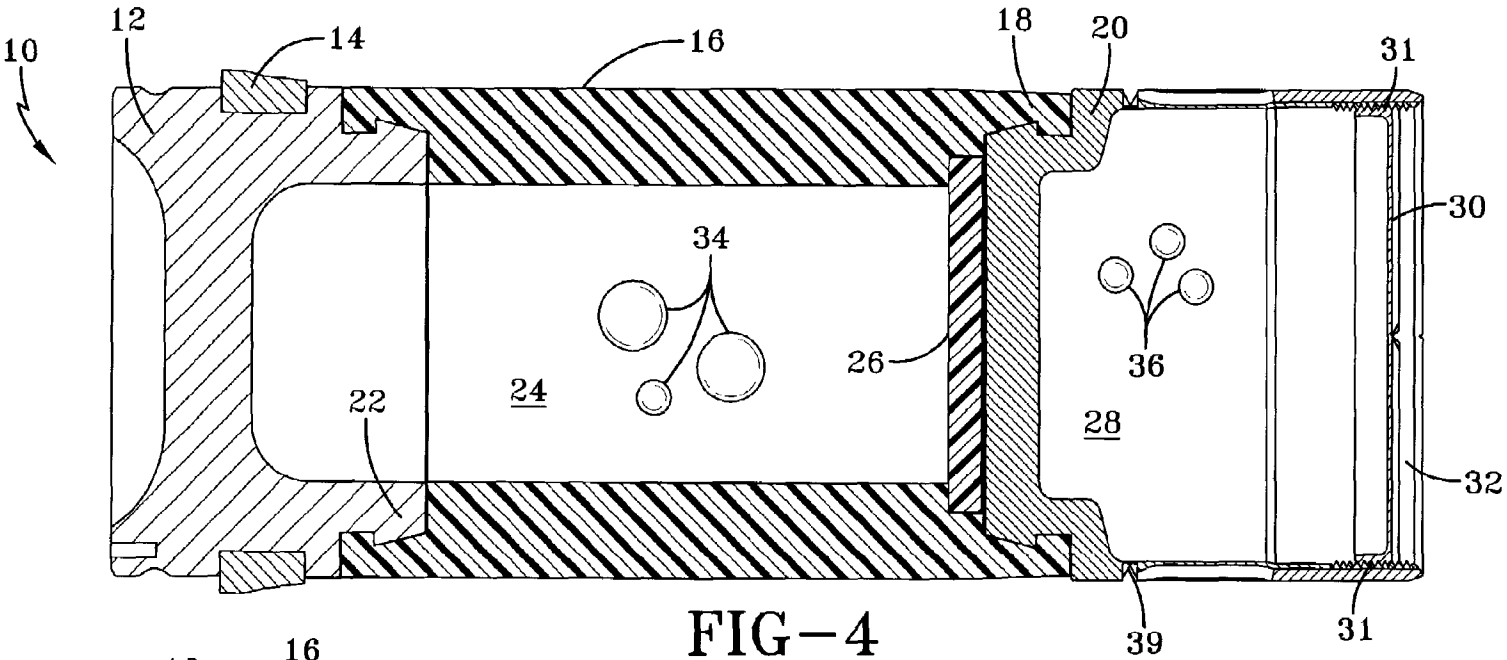
FIG. 4 is a sectional side view of a first embodiment of a canister projectile.

FIG. 4 is a sectional side view of a first embodiment of a canister projectile 10. Projectile 10 comprises a base 12 and a body 16 connected to the base 12 with a first (aft) snap joint 22. The first snap joint 22 allows relative rotation between the base 12 and the body 16. A can 20 having an open forward end 32 is connected to the body 16 with a second (forward) snap joint 18. The second snap joint 18 allows relative rotation between the body 16 and the can 20. An aft payload 24 is disposed in the body 16. A forward payload 28 is disposed in the can 20. A cap 30 is connected to the can 20 and closes the open forward end 32 of the can 20. Cap 30 includes external threads 31 that engage internal threads in the forward end 32 of can 20.

The base 12 functions as a pusher plate to support the projectile 10 as it travels down the cannon barrel. In the embodiment of FIG. 4, base 12 is made of aluminum. Aluminum was selected for weight reduction and cheaper manufacturing cost. The base 12 is anodized to protect against gun gases and possible engraving. The aluminum base 12 provides support for the obturator 14.

The obturator 14 comprises a nylon band that provides a gas seal between the gun tube wall and the projectile 10 as it travels down the tube. The obturator 14 engages the rifling and transmits some torque to the base 12 of the projectile 10, which is transferred into projectile spin. The primary purpose of the obturator 14 is to provide a gas seal. It is not intended to transmit torque to the projectile body 16, or to spin the entire projectile 10, even though a limited amount of torque is transmitted.

The nylon body 16 is generally tubular and is important to the dual spin concept. The nylon body 16 contains the aft payload 24 that achieves Cone Angle 1 (FIG. 2). Nylon plastic was chosen as the body material because it possesses material properties that allow the sub-caliber diameter body 16 to bulge, engrave to a super-caliber diameter, and then shatter at muzzle exit to release the enclosed payload 24 with minimal interference. The rifling engagement, or engraving, allows the nylon body 16 to transmit torque from the rifling and enables the body 16 to attain a high spin rate. The interior diameter of the nylon body 16 is directly proportional to the dispersion achieved at muzzle exit. This interior diameter can be "tuned" or adjusted to meet the specific pattern diameter required at the desired range. The plastic rear body 16 also helps in the reduction of gun tube wear from repeated firings.

The forward snap joint 18 interfaces the nylon body 16 with the aluminum can 20. This joint 18 is essential to achieve the dual spin rate function. The overlapping joint 18 has an interference fit that holds the nylon body 16 and can 20 concentric and tight. This joint 18 is inexpensive to machine and easy to assemble. The low coefficient of friction between the nylon and aluminum materials prevents torque transfer from the aft body 16 and the obturator 14, thus allowing the can 20 to attain a low spin rate.

Figure 5:
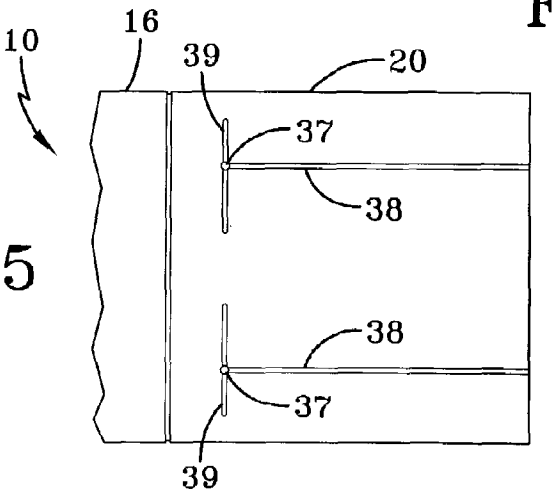
FIG. 5 is an exterior view of a can showing the scoring thereon.

The can 20 carries the forward payload 28 that creates dispersion Cone Angle 2 (FIG. 2). The can 20 is constructed of aluminum for various reasons that include: inexpensive manufacturing costs, reduced weight, and material properties that permit the desired opening characteristics. The aluminum can 20 has scoring on the outside surfaces. While the scoring on can 20 may include many variations, a preferred scoring allows the can 20 to break into four consistent pieces or petals to release the payload 28. At muzzle exit, the can 20 splits along the score marks. FIG. 5 is an exterior view of a can 20 showing an example of the scoring thereon.

In the example of FIG. 5, the scoring includes four longitudinal scores 38 (along the projectile axis) and four separate circumferential scores 39 that combine to create four "T" shaped scores on the exterior of the can 20. At the intersection of the vertical and circumferential scores, a hole 37 is drilled part way through the wall thickness to prevent the propagating cracks that create the petals from splitting the base of the can. This configuration leaves a "plastic hinge" of material between the T scores that on discard will be the pivot point prior to the petal breaking off completely from the can.

"Plastic hinge" describes the dynamic motion of the petal as it bends open. The metal is highly stressed and experiences plastic yielding, or permanent deformation, before it eventually breaks off. Since the petal pivots on this location, it is referred to as a plastic hinge. Prior to breaking off, the hinged petals also serve to slow down the can 20 while the payload 28 is free to continue moving down range. The can 20 is also anodized to create a hard exterior surface that will prevent the can from engaging the rifling (engraving).

The aft snap joint 22 interfaces the base 12 with the nylon body 16. The aft snap joint 22 closely resembles the forward snap joint 18, however, the function is quite different. The aft snap joint 22 is intended to provide some slip between the body 16 and base 12 during torque application. The base 12 begins to torque via the obturator 14 when the projectile 10 begins to move down the gun barrel, whereas the nylon body 16 begins to engrave and torque at a later point down the barrel. This timing difference can cause a large torque gradient between the base 12 and body 16 that can shear certain joints, such as a threaded joint. The slip provided by the aft snap joint 22 provides compliance between the base 12 and body 16 until they achieve the same spin rate and torque levels. In addition, the snap joint 22 provides a "lap joint" (overlap) interface as oppose to a "butt joint" interface that creates a better gas seal. The snap joint 22 also provides the same cost reduction and ease of assembly features as the forward snap joint 18.

The aft payload 24 contains, for example, metal spheres 34 of uniform or mixed diameters. Preferably, the spheres 34 comprise tungsten. The aft payload 24 attains a high spin rate and disperses Cone Angle 1 (FIG. 2). The payload 24 can be potted, or encased, in epoxy or rubber of various types. This directly affects how the load is transferred to the nylon body 16 during gun launch. Potting the payload 24 creates more of a column load versus non-potted payload that typically resembles a hydrostatic load condition. A balance is required to ensure enough load is transferred to engrave the nylon body 16 at all temperature extremes while limiting the load enough to prevent damage to the gun. The arrangement of the payload 24 in a mixed size or shape configuration directly correlates to the down range pattern. In other words, placing a specific payload type or size in the center of the body 16 prior to firing will result in that payload maintaining that position within the pattern after firing.

The bulkhead 26 is made of nylon and is intended to provide a buffer between the aft payload 24 and the can 20. This buffer ensures that a consistent friction coefficient is maintained between the nylon body 16 and can 20, thus ensuring repeatable decoupling of the forward and aft bodies.

The forward payload 28 comprises, for example, spheres 36 enclosed within the can 20. Preferably, spheres 36 comprise tungsten. Since the can 20 and payload 28 attain a low spin rate, the forward payload 28 is dispersed into Cone Angle 2 (FIG. 2). The primary mechanism for this spreading is aerodynamic forces.

Figure 6:
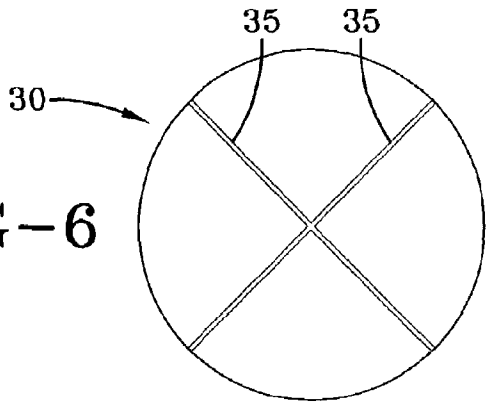
FIG. 6 is a top view of a cap showing the scoring thereon.

The cap 30 contains the payload 28 within the can 20. The cap 30 is made of aluminum and is designed to breakup during maximum gun launch forces while traveling down the cannon. FIG. 6 is a top view of a cap 30 showing the scoring thereon. While the scoring on cap 30 may include many variations, FIG. 6 shows the cap 30 scored with "V" shaped grooves 35 radially from the center. Anywhere from four to eight grooves 35 are used to break the cap 30 into small pie shaped wedges to prevent the cap from interfering with ball dispersion on muzzle exit.

Sequence of Operation

The cartridge 10 is loaded into the cannon and the propellant charge is initiated. When gas pressure builds significantly, the projectile 10 moves forward and the obturator 14 is forced into the rifling. Subsequently, the obturator 14 is engraved and begins to transfer torque to the base 12 and body 16. The aft snap joint 22 begins to slip. After traveling approximately 20% of the length of an M68 gun tube, the peak gun launch forces compress the nylon body 16 between the base 12 and can 20. The aft payload 24 applies outward pressure that causes the nylon body 16 to engage the rifling and begin to engrave. Torque is then transferred into the nylon body 16 causing the body 16 and base 12 to achieve a high spin rate.

The can 20 does not engrave on the rifling. When the body 16 begins to achieve a high spin rate, minimal torque is capable of being transferred via the forward snap joint 18, therefore the can 20 and forward payload 28 attain a very low spin rate. In addition, at peak gun compressive loads, the forward payload 28 forces outward on the can walls causing the longitudinal scores to develop cracks.

At muzzle exit, the body 16 and base 12 have now reached a full spin rate of up to 550 Hz and the can 20 has reached a low spin rate of 0-30 Hz. Cracks propagate along the scoring in the can 20 creating four symmetric petals that bend on the plastic hinge and eventually break off and discard outward allowing the balls to release and form Cone Angle 2 (FIG. 2). Prior to breaking off, the hinged petals also serve to slow down the can 20 while the payload is free to continue moving down range. The body 16 exits the gun and, due to the engraving process, has a number of external grooves formed thereon.

For example, if the projectile 10 is launched from an M68 cannon, the body 16 will exit the gun with twenty-eight grooves formed thereon. These grooves, in conjunction with the high compressive state due to the inertial and front stage loads, the low material strength of nylon, and high centripetal load of the balls pushing outward, shatter the nylon body 16 and allow the aft payload 24 to disperse into Cone Angle 1 (FIG. 2). The nylon body 16 breaks up into enough small pieces so that the aft payload 24 forms a symmetrical pattern without interference from the discarding parts of the projectile body 16.

Further Embodiments

Figure 7:
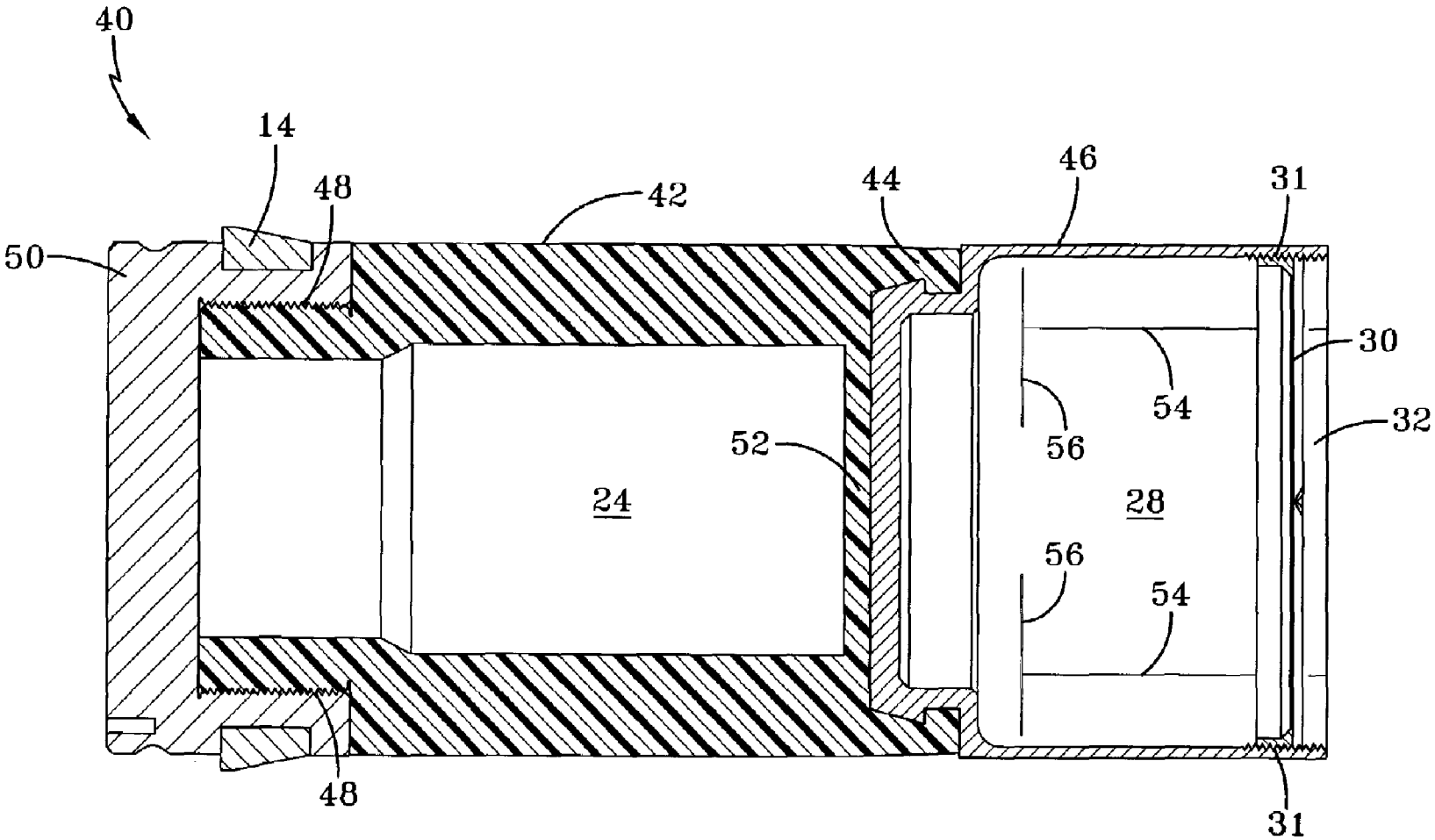
FIG. 7 is a sectional side view of a second embodiment of a canister projectile.

FIG. 7 is a sectional side view of a second embodiment of a canister projectile 40. Projectile 40 comprises a base 50 and a body 42 connected to the base 50 such that the base and the body rotate together. In one embodiment, the connection between the base 50 and body 42 is a threaded connection 48. A can 46 has an open forward end 32 and is connected to the body 42 with a snap joint 44. The snap joint 44 allows relative rotation between the body 42 and the can 46. An aft payload 24 is disposed in the body 42 and a forward payload 28 is disposed in the can 46. A cap 30 is connected to the can 46 and closes the open forward end 32 of the can 46. Cap 30 includes external threads 31 that engage internal threads in the forward end 32 of can 46.

Base 50 is similar to base 12, except that the connection between base 50 and body 42 is a rigid connection that does not allow relative rotation between the base 50 and body 42, rather than a snap joint that allows relative rotation. Threaded connection 48 allows one to load the payload 24 from the bottom of the projectile 40. Base 50 preferably comprises aluminum. The body 42 functions similar to the body 16 of the first embodiment. However, nylon body 42 is preferably machined from bar stock to incorporate an integral forward bulkhead 52 and the variation in the internal diameter.

Snap joint 44 functions similar to snap joint 18, except snap joint 44 has a steel to nylon friction coefficient rather than an aluminum to nylon friction coefficient. The can 46 is made of steel, whereas the can 20 is made of aluminum. Steel can 46 carries the forward payload 28 that creates dispersion Cone Angle 2 (FIG. 2). Because steel has a very high strength compared to aluminum, the can 46 includes slots (cut all the way through) as opposed to scores (partial depth cuts). The design of the slots on can 46 mimics the scoring on can 20, i.e., four longitudinal slots 54 (along the projectile axis) and four separate circumferential slots 56 that combine to create four "T" shaped slots on the exterior of the can 46. The slots on can 46 allow it to break into four consistent pieces or petals to release the payload 28. At muzzle exit, the aerodynamic forces cause the petals to bend backward and open like a flower. This configuration leaves a "plastic hinge" of material between the T slots that on discard will be the pivot point prior to the petal breaking off completely from the can 46. The high hardness of steel prevents the petals from engraving.

Figure 8:
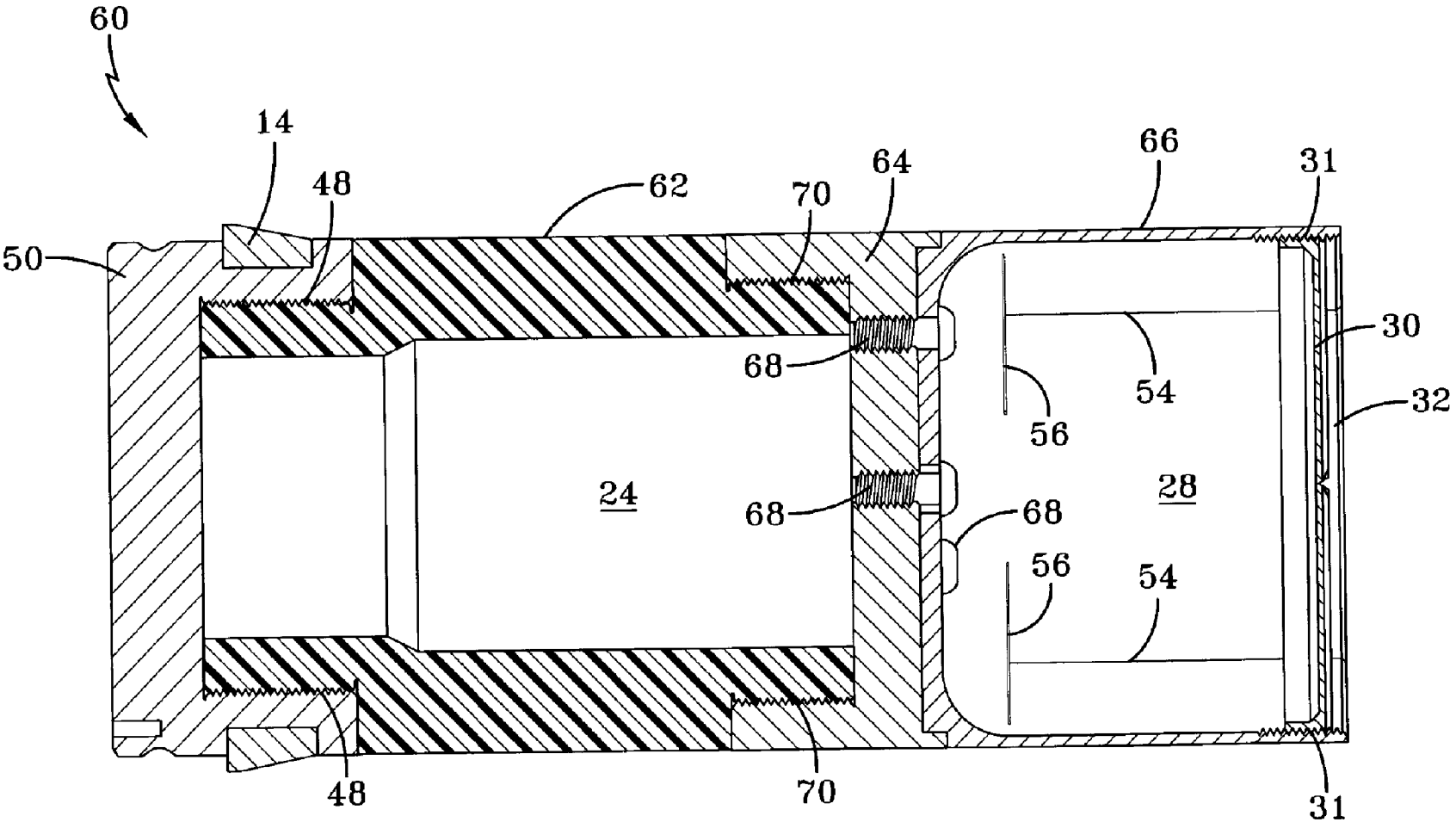
FIG. 8 is a sectional side view of a third embodiment of a canister projectile.

FIG. 8 is a sectional side view of a third embodiment of a canister projectile 60. Projectile 60 includes a base 50 and a body 62 connected to the base 50 such that the base 50 and the body 62 rotate together. In one embodiment, the connection between the base 50 and body 62 is a threaded connection 48. A bulkhead 64 is connected to the body 62 such that the bulkhead 64 and the body 62 rotate together. In one embodiment, the connection between the bulkhead 64 and the body 6 is a threaded connection 70. Bulkhead 64 receives torque from the body 62. An obturator 14 fits around the base 50.

A can 66 having an open forward end 32 is connected to the bulkhead 64 with at least one shear bolt 68. Of course, more than one shear bolt 68 may be used. Shear bolts 68 are designed to break at a predetermined torque load. The can 66 includes holes therein for receiving the shear bolts 68. The shear bolts 68 transfer torque from the bulkhead 64 to the can 66 until the torque load shears the bolts 68. By adjusting the shear strength and/or quantity of the bolts 68 used, the desired torque and, therefore, the desired spin rate can be transferred to the can 66. In this way, the can 66 achieves a controlled spin rate between low spin and full spin.

An aft payload 24 is disposed in the body 62 and a forward payload 28 is disposed in the can 66. A cap 30 is connected to the can 66 and closes the open forward end 32 of the can 66. Cap 30 includes external threads 31 that engage internal threads in the forward end 32 of can 66. The base 50 comprises aluminum, the body 62 comprises nylon, the bulkhead 64 comprises aluminum and the can 66 comprises steel. An exterior surface of the can 66 includes slots 54, 56 formed therein to facilitate breakup of the can 66.

Figure 9:
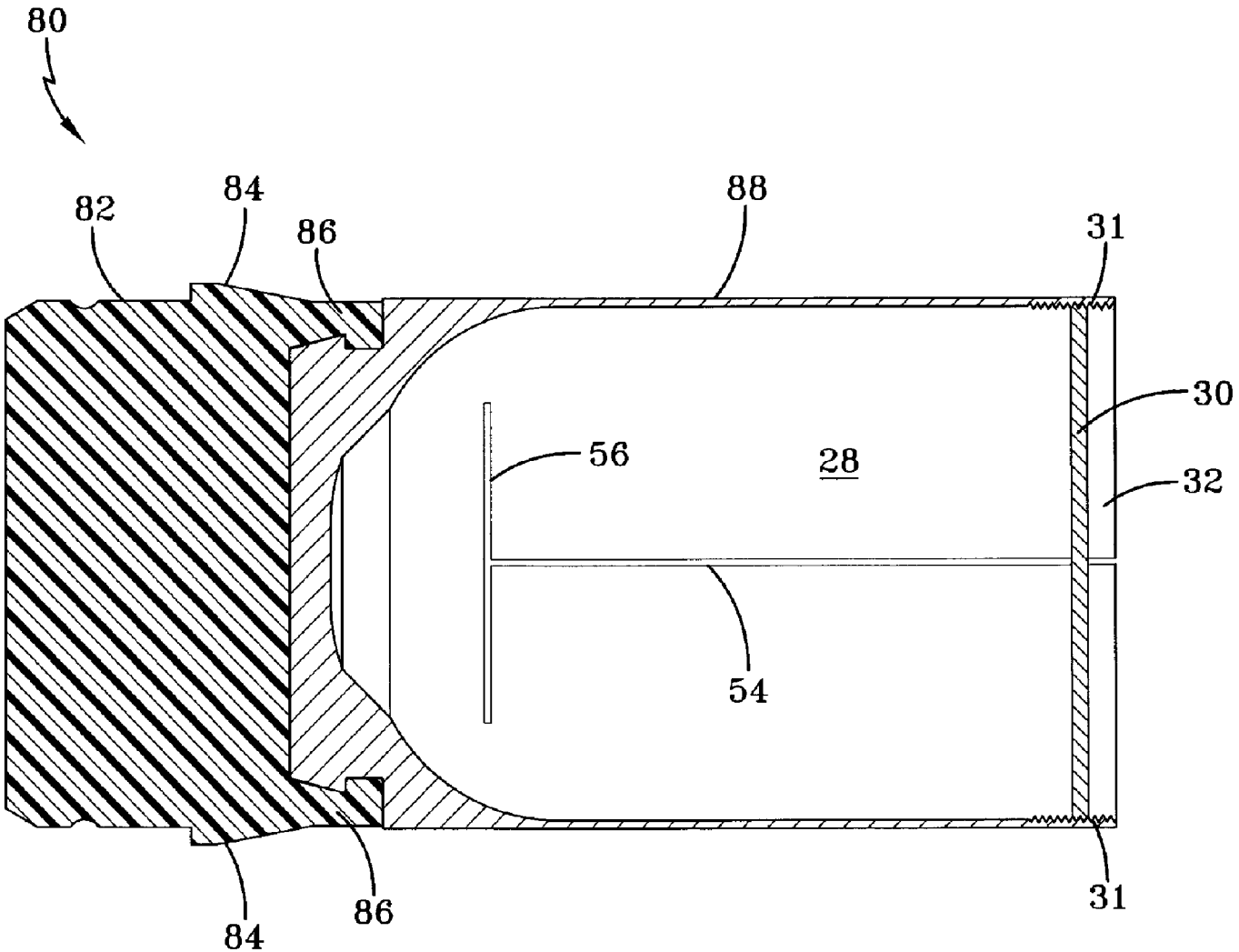
FIG. 9 is a sectional side view of a fourth embodiment of a canister projectile.

FIG. 9 is a sectional side view of a fourth embodiment of a canister projectile 80. Projectile 80 includes a base 82 and a can 88 connected to the base 82 with a snap joint 86. The snap joint 86 allows relative rotation between the base 82 and the can 88. The can 88 has a forward open end 32. A payload 28 is disposed in the can 88. A cap 30 is connected to the can 88 and closes the open forward end 32 of the can 88.

The base 82 comprises nylon and serves a pusher plate for the can 88. The base 82 includes an integrated obturator 84. The can 88 is made of steel and contains the single payload 28. Slots 54, 56 achieve the same function and opening characteristics as described with regard to other embodiments. The snap joint 86 transfers enough torque for can 88 to attain low spin. On muzzle exit a single dispersion with Cone Angle 2 (FIG. 2) is achieved.

Figure 10:
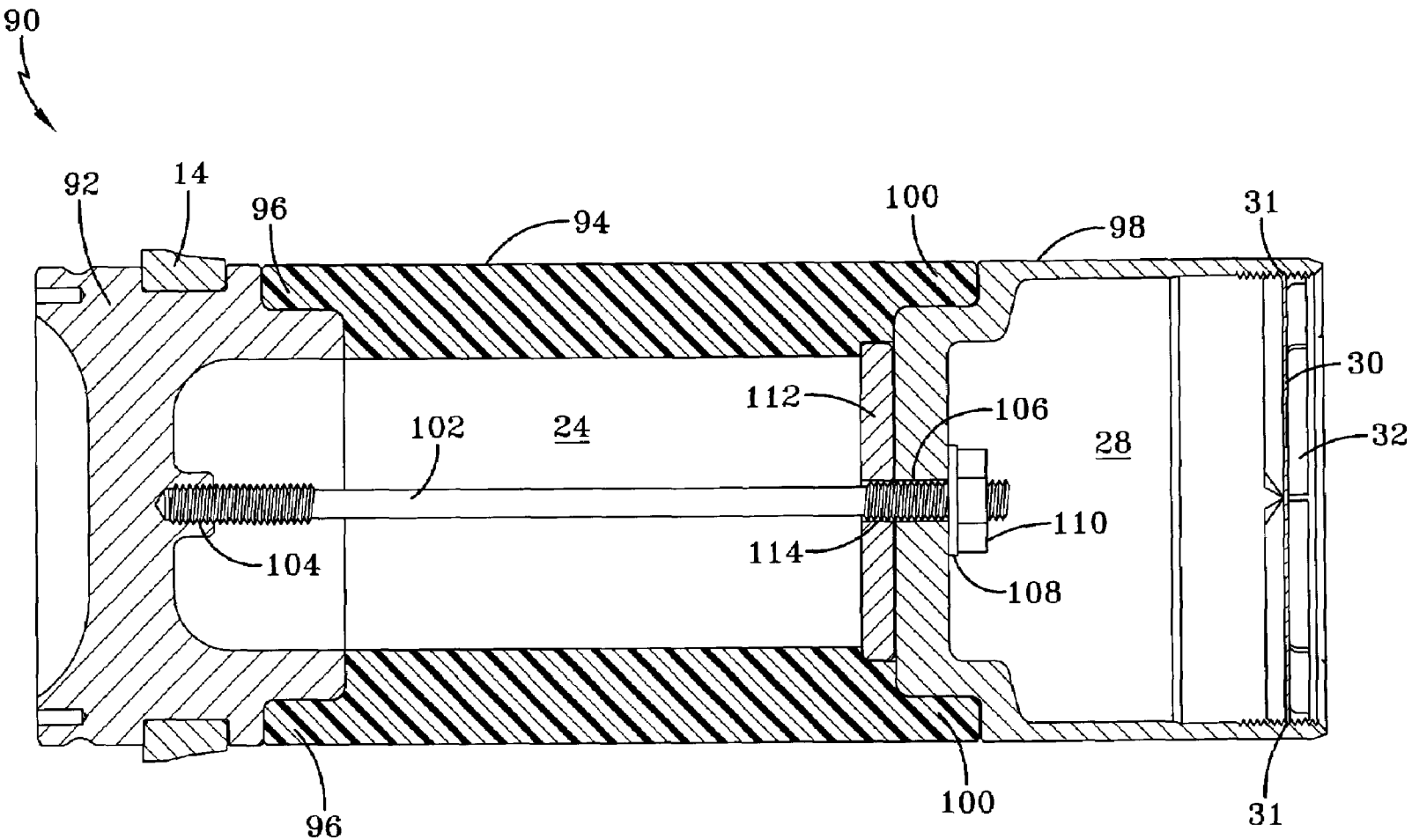
FIG. 10 is a sectional side view of a fifth embodiment of a canister projectile.

FIG. 10 is a sectional side view of a fifth embodiment of a canister projectile 90. Projectile 90 includes a base 92 and a body 94 connected to the base 92 with a first lap joint 96. The first lap joint 96 allows relative rotation between the base 92 and the body 94. Lap joint 96 provides radial support between the base 92 and body 94. The lap joint 96 has a reduced joint stress compared to the snap joint 22 in FIG. 3. Also, compared to snap joint 22, the lap joint 96 has a larger nylon cross section that results in added strength.

A can 98 has an open forward end 32 and is connected to the body 94 with a second lap joint 100. The second lap joint 100 allows relative rotation between the body 94 and the can 98. Lap joint 100 provides radial support between the body 94 and the can 98. Lap joint 100 functions similarly to snap joint 18 in FIG. 3. However, the lap joint 100 has a reduced joint stress and a larger nylon cross section, for greater strength. An obturator 14 is disposed on the base 92.

A bolt 102 is fixed in a central opening 104 in the base 92 and extends through a central opening 106 in the can 98. A washer 108 and nut 110 on the end of the bolt 102 hold the base 92 to the can 98 while allowing the bolt 102 and base 92 to rotate relative to the can 98. The bolt 102 is more robust compared to the snap joints 22, 18 of FIG. 3. Bolt 102 helps relieve the axial load on the body 94, especially in extreme temperatures. An aft payload 24 is disposed in the body 94 and a forward payload 28 is disposed in the can 98. A cap 30 is connected to the can 98 and closes the open forward end 32 of the can 98.

A bulkhead 112 is disposed between the aft payload 24 and the can 98. The bolt 102 passes through a central opening 114 in the bulkhead 112. The base 92 comprises aluminum, the body 94 comprises nylon, the bulkhead 112 comprises nylon and the can 98 comprises aluminum. As shown in FIG. 5, the exterior surface of the can 98 includes scoring thereon to facilitate breakup of the can.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A gun-launched projectile for firing from a rifled barrel, comprising:

a base;

a body connected to the base with a first lap joint, the first lap joint allowing relative rotation between the base and the body;

a can having an open forward end and connected to the body with a second lap joint, the second lap joint allowing relative rotation between the body and the can;

a bolt fixed in a central opening in the base, extending through a central opening in the can and ending with a nut to thereby hold the base to the can while allowing the bolt and base to rotate relative to the can;

an aft payload comprising a plurality of substantially spherical subpayloads disposed in the body;

a forward payload disposed in the can; and a cap connected to the can and closing the open forward end of the can.

2. The projectile of claim 1 further comprising a bulkhead disposed between the aft payload and the can, the bolt passing through a central opening in the bulkhead.

3. The projectile of claim 1 wherein the base comprises aluminum, the body comprises nylon and the can comprises aluminum.

4. The projectile of claim 1 wherein an exterior surface of the can includes scoring thereon to facilitate breakup of the can.

* * * * *